US010059498B2

(12) United States Patent
Barton

(10) Patent No.: US 10,059,498 B2
(45) **Date of Patent: *Aug. 28, 2018**

(54) THERMOFORMED FLEXIBLE DISPENSING CONTAINER WITH INTEGRALLY FORMED FLAT BOTTOM FOR A STAND-UP CONFIGURATION

(71) Applicant: Barton Group, Inc., East Hampton, NY (US)

(72) Inventor: Lewis Barton, Wainscott, NY (US)

(73) Assignee: Barton Group, Inc., East Hampton, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/284,215

(22) Filed: Oct. 3, 2016

(65) Prior Publication Data

US 2017/0096271 A1 Apr. 6, 2017

Related U.S. Application Data

(60) Provisional application No. 62/236,775, filed on Oct. 2, 2015.

(51) Int. Cl.
*B65D 75/00* (2006.01)
*B65D 75/58* (2006.01)
(Continued)

(52) U.S. Cl.
CPC ..... *B65D 75/008* (2013.01); *B65B 7/164* (2013.01); *B65D 75/326* (2013.01); *B65D 75/5822* (2013.01); *B65D 75/5866* (2013.01)

(58) Field of Classification Search
CPC .. B65D 75/006; B65D 75/008; B65D 75/326; B65D 75/366; B65D 75/5822;
(Continued)

(56) References Cited

U.S. PATENT DOCUMENTS 2,705,579 A 4/1955 Mason
3,207,420 A 9/1965 Navarrete-Kindelan
(Continued)

FOREIGN PATENT DOCUMENTS

FR 2801283 A1 5/2001

*Primary Examiner* — Nicholas J Weiss
(74) *Attorney, Agent, or Firm* — Abelman, Frayne & Schwab

(57) ABSTRACT

A flexible thermoformed dispensing package for a flowable material that can be massed produced on a horizontal thermoform-fill-seal (HTFFS) machine includes a container portion that is dimensioned and configured with a flat self-supporting base, integral opposing side walls and a rear wall extending from the base, and a top wall or seam integrally formed from a single sheet or web, the side walls tapering from the base toward the integral rear wall and terminating at the top wall or seam; and a front wall that is heat-sealed as a separate sheet to the periphery of the periphery of the base, side walls and top wall to form a fluid-tight package that maintains a stand-up orientation when in use, and optionally includes an integral dispensing tube with an optional internal extension terminating proximate the supporting base for withdrawing liquid contents from the package.

14 Claims, 8 Drawing Sheets

(51) Int. Cl.
*B65B 7/16* (2006.01)
*B65D 75/32* (2006.01)

(58) Field of Classification Search
CPC ..... B65D 75/5866; B65D 2575/3236; B65D 2575/366; B65D 2575/367; B65D 83/0055
See application file for complete search history.

(56) References Cited

U.S. PATENT DOCUMENTS 3,640,430 A 2/1972 Roberts
3,759,375 A 9/1973 Nappi
3,908,864 A 9/1975 Capper
3,913,734 A 10/1975 Siegel
3,940,018 A 2/1976 Scholle
4,069,951 A 1/1978 Von Winckelmann
4,314,654 A 2/1982 Gaubert
4,322,018 A 3/1982 Rutter
4,322,465 A 3/1982 Webster
4,416,395 A 11/1983 Gaubert
4,491,245 A 1/1985 Jamison
4,491,247 A 1/1985 Nitchman et al.
4,491,250 A 1/1985 Liebermann
4,798,324 A * 1/1989 Gannon ..... B65D 75/58 220/203.16
4,838,429 A 6/1989 Fabisiewicz et al.
4,871,091 A 10/1989 Preziosi
4,935,283 A 6/1990 Jamison
4,949,878 A 8/1990 Jacobi
4,974,732 A 12/1990 Sullivan et al.
4,988,016 A 1/1991 Hawkins et al.
5,104,002 A 4/1992 Cahlander et al.
5,167,973 A 12/1992 Snyder
5,203,459 A 4/1993 Wade
5,337,539 A 8/1994 Barton
5,348,191 A 9/1994 Dekeyser
5,356,039 A 10/1994 Christine et al.
5,411,178 A 5/1995 Roders et al.
5,632,416 A 5/1997 Lane, Jr. et al.
5,647,511 A 7/1997 Bond
5,735,423 A 4/1998 Black
5,931,345 A 8/1999 Lane, Jr. et al.
6,094,886 A 8/2000 Poignant
6,196,420 B1 3/2001 Gutierrez et al.
6,360,916 B1 3/2002 Sokolsky et al.
6,561,383 B1 5/2003 Reddy et al.
6,620,436 B1 9/2003 Rolf
6,624,130 B2 9/2003 Giblin et al.
6,651,848 B1 11/2003 Redmond
6,779,657 B2 8/2004 Mainwaring et al.
6,883,683 B1 4/2005 Cunningham et al.
D512,651 S 12/2005 Stefandl
7,021,495 B2 4/2006 Da Laforcade
7,334,702 B2 2/2008 Cunningham et al.
7,690,555 B2 4/2010 Churvis et al.
8,141,709 B2 3/2012 Klaus
8,430,266 B2 4/2013 Barton
8,997,992 B2 * 4/2015 Van Puijenbroek ..... B65D 1/22 206/233
9,187,225 B2 11/2015 Barton
2003/0029884 A1 2/2003 Rau
2003/0231808 A1 12/2003 Machacek et al.
2004/0118859 A1 6/2004 Stefandl
2006/0086640 A1 4/2006 Luciano, Jr. et al.
2007/0228073 A1 10/2007 Mazzarino
2007/0231431 A1 10/2007 Roche et al.
2010/0086239 A1 4/2010 Latour
2011/0272421 A1 11/2011 Barton

* cited by examiner

THERMOFORMED FLEXIBLE DISPENSING CONTAINER WITH INTEGRALLY FORMED FLAT BOTTOM FOR A STAND-UP CONFIGURATION

FIELD OF INVENTION

The present invention is directed to improved flexible packaging for liquids, viscous fluids and solid flowable products that are capable of standing up in a self-supporting position during use and for retail sales display, and to methods for the manufacture of the packaging.

BACKGROUND OF THE INVENTION

The retail and food service industries are large-volume purveyors of beverages and other flowable food products such as syrups and condiments in a variety of container configurations that are sold to or provided for use by consumers. Many of these products can advantageously be sold as stand-up packages for beverages, including water (both natural and flavored), ice teas, energy drinks, non-carbonated fruit-flavored drinks and concentrated drink mixes, as well as flowable dry products such as rice and sugar, to name just a few. In some cases, stand-up packages of the prior art have a separate bottom gusset that expands when filled to form an essentially flat supporting base to allow the package to stand up on the extended gusseted bottom.

Stand-up flexible packaging, or pouches, for liquids provide the benefits of rigid packages such as glass and plastic bottles and plasticized paperboard cartons, including the ability of the user to set the pouch down between servings, as in beverage use, and the benefit of providing a classic billboard type principal display panel for merchandising at the retail level. Conventional stand up pouches are generally made by introducing a gusset in the bottom in order to provide a flat bottom surface able to provide the base for the standup feature (see FIG. 1).

Flexible packaging products that include an integral internal dispensing tube, or straw, bar use with, e.g., beverages, and are formed with a gusset to provide the stand-up capability are described in published US 2015/0090740, the entire disclosure of which is incorporated herein by reference.

These types of prior art packages have several drawbacks including the complexity of multiple methods of fabricating the gusset, the additional material required and the relatively higher cost associated with their production. Gussets can be formed by one of two methods: (a) folding the material in a manner so as to form the gusset integrally from the piece of packaging material; and (b) adding a separate piece of folded material between the two front and back sheets to produce the same result. Using the added piece allows the construction with either a thicker, more rigid piece bar the gusset adding a benefit of either a more robust and better package, or a more economical package because adding the thicker gusset permits use of thinner and, therefore less expensive front and back panels.

Some flexible containers of the prior art can advantageously be formed and filled with any desired dispensable liquid or flowable substance utilizing horizontal thermo-form-fill-seal ("HTFFS") machines which are well known in the packaging industry. The construction, use and process of operation of HTFFS equipment is described in U.S. Pat. No. 4,322,465, the entire disclosure of which is incorporated herein by reference. The container portion of the package is thermoformed and a top sheet is heat-sealed around the periphery to provide a fluid-tight flexible dispensing package. Various packaging machine manufacturers and distributors in the U.S. and outside of the U.S. have posted animations at their respective websites that illustrate a variety of prior art methods and systems for producing thermoformed packages, blister packs, and the like. A typical informational web posting for such packaging machines is found at ulmapackaging.com.

As noted, manufacturers have been distributing a variety of beverages in packages formed from polymeric flexible sheets and webs in a package formed with a gusset in the base. When combined with the relatively heavy gauge polymer films used to form the front and rear walls, the additional material required to form the gusset with the opposing front and rear panels of the package provides sufficient structural integrity to permit the finished package, even when empty, to maintain a stand-up orientation. The use of this heavier gauge material results in an added amount of waste packaging material that must be subjected to proper disposal.

In the present era of both governmental and consumer concern with the adverse impact of waste packaging materials on the environment and the costs associated with their recovery and proper disposal, the problem exists of providing a truly lightweight, but robust and durable form of packaging to replace glass, plastic and paperboard containers. The economical mass production of flexible lightweight packages from one or more polymer films is possible on the conventional horizontal thermoforming, fill and seal machines that are well known in the art. However, gusseted packages cannot be produced on the conventional HTFFS machines without significant modifications to accomplish additional folding steps and possibly an additional web.

A need exists for less expensive packaging for liquids such as milk and fruit juices that are mass-distributed in single-serve portions on a daily basis, e.g., to school children, that will also reduce the burden on the environment associated with their disposal.

Another need that has not been met by the prior art is for dispensing packages for liquids and other flowable materials that are inexpensively produced from flexible, thermoformable polymer films and webs in a stable stand-up configuration for consumer use and that are suitable for retail display on shelves and at the point of sale.

SUMMARY OF THE INVENTION

The above problems are resolved and numerous other advantages and benefits are realized by the improved thermoformed flexible container of the present invention that has an integral flat, or planar supporting base configured and dimensioned for a stable stand-up package orientation during use in which the container portion is formed with a supporting flat base and the integral opposing side walls and the rear wall extending from the flat base terminate either at a top wall opposite the flat base or in a peripheral region that is heat-sealed to a top cover sheet so that the filled and sealed flexible container expands above the base to lower the center of gravity of the flexible package, allowing the user to stand the package on its flat base prior to and during use as the contents are withdrawn or dispensed.

An embodiment of the present invention broadly comprehends an improvement to thermoformed flexible packages by eliminating the gusseted or folded bottom and instead providing a package configured and dimensioned with a proportionally larger base, tapered side walls and a rear wall joined to the relatively smaller top wall, or to a heat-sealed seam to thereby integrally form the container portion from a polymeric bottom sheet or web onto which is then applied a lidding or cover sheet that is heat-sealed around the periphery of the flexible thermoformed container portion to form the front panel of the package. This permits the front panel to be pre-printed with labeling and desired indicia and other information on the web fed to the HTFFS machine. Suitable machines for use in the practice of the invention are available from many firms including Multivac, Ulma and Reiser, among others.

When filled, e.g., with a liquid "L" and the base of the container portion is placed on a horizontal surface, the product, whether it be a beverage, a more viscous liquid or a flowable solid will gravitate or settle and expand the flexible side walls extending from the base. The package is thereby reconfigured from the planar shape as originally defined by, and formed in the package the die, and results in having a lower, stabilizing center of gravity. Flexible packaging so configured and dimensioned will produce a stand-up feature allowing the user to dispense or withdraw a portion of the liquid, return the package to the surface, and then, at a later time, withdraw the balance of the product from the package.

The dispensing package of the invention can be provided with a single dispensing tube positioned opposite the supporting flat base in accordance with the method described in U.S. Pat. No. 8,381,941. As an option, the dispensing package of the present invention can be provided with an integral extended internal dispensing tube of the prior art as shown, bar example, in FIG. 7 by employing a die or mold of the type illustrated in FIG. 6 in accordance with the disclosure of published application US 2015/0090740, the entire disclosure of which is incorporated herein by reference. The dispensing tube, with or without an internal extension, can also be positioned centrally or otherwise displaced from a side wall and opposite the supporting flat base.

In the mass production of the flexible dispensing packages of this invention, the molds or dies are advantageously configured and arranged on the HTFFS machine in the manner illustrated and described in FIG. 6F of US 2015/0090740. The configuration illustrated facilitates the die-cutting to separate the individual packages and also reduces the waste material from the continuous web fed to the machine. As discussed above, the dies or molds shown in FIG. 6F and elsewhere in US 2015/0090740 can be modified to produce the embodiment of the present invention without the internal extension of the dispensing tube by eliminating the internal wall 620 shown in the series of FIGS. 6A, 6B and 6F.

As will also be understood by one of ordinary skid in the art, the length of the external dispensing tube during use can be predetermined by the placement of the weakened tear line 3 across the closed distal end 930 of the tube, e.g., as illustrated in FIG. 9. The die-cut notches and laser score line can be provided before or after the filled packages are separated.

In another embodiment of the invention, the horizontal die of the HTFFS machine is configured with a container portion in which the bottom wall that is opposite the opening in the die forms the base with opposing side walls extending between front and rear walls and the front wall extends to a greater depth in the die. In this embodiment, the front side wall is preferably provided with a dispensing tube having an internal extension. After the cover or lidding is heat-sealed to the periphery of the container portion and, optionally, to complete the closing of the dispensing tube, the periphery is sealed. When the filled package is removed from the die, the contents will cause the side walls to expand and leave an air space between the surface of the liquid and the cover sheet when the package is placed on a horizontal surface. It will be understood that a package of this configuration will require a base having a relatively larger area and provides a lower profile than the previously described embodiment. The orientation of the dispensing straw, if provided, will be at an acute angle to the horizontal as opposed to the essentially vertical orientation of the previously-described embodiment. This particular configuration forming a "flat" package permits easy stacking for storage and/or transportation, and may find an advantageous use with individuals having special needs, e.g., a bedridden patient who may find it easier to reach the dispensing tube extending at a relatively low angle from a bedside tray or table.

A further embodiment of the dispensing package of the present invention is provided with one or more weakened tear lines at an upper corner or along a portion of a heat-sealed region at the top of the package to permit the contents to be poured from the package. Alternatively, a zip seal can be provided in the lidding or cover sheet that is heat-sealed to the container portion to permit resealing of the package after dispensing a portion of the contents. Zip seals are in use on a variety of consumer products and suitable seals and their method of use are shown on the websites of the Zip-Pak division of Illinois Tool Works Inc. of Manteno, Ill., zippak.com and Presto Products Company of Appleton, Wis., fresh-lock.com.

As an alternative, or in addition to providing one or more tear notches to facilitate and assure ease of opening by the user, the flexible packaging material can be laser scored. Laser scoring assures the precision separation of the portion to be removed by controlled score depth that maintains the integrity of the flexible polymeric material. Automated computer-controlled equipment for the laser scoring of flexible packaging materials is commercially available from numerous sources, including LASX Industries, Inc. of St. Paul, Minn., www.lasx.com; Laser Sharp FlexPak Services, LLC of Vadnais Heights, Minn.; and Preco, Inc., Lenexa, Kans.

As used herein, the terms "web" and "sheet" will be understood to refer to the polymeric material(s) that are preferably used to form the package(s) of the present invention. As will be understood by those of ordinary skill in the art, the polymeric material(s) are advantageously provided to an automated package forming and filling machine in rolls and fed to the machine as a continuous web. The web can be thermoformed in conjunction with a vacuum and/or a mechanical plug, then filled and heat-sealed to form the package from which any unwanted material is trimmed or die-cut, and by which multiple-formed packages joined to the web are separated into individual packages, generally as a final step. A sheet is typically formed by transversely cutting a predetermined length from a web. In any event, it will be understood that the terms sheet and web may be used interchangeably and that the meaning will be apparent from the context to one of ordinary skill in the art. Optionally, for specific applications and systems the web can be cut on the fly to provide sheets to the machine and processed as described above. The use of sheets can be employed for relatively small runs of a given packaging configuration, for prototype development and/or where capital costs of continuous-run form and till production equipment are of concern.

As used herein, the term "lidding" material means that portion of the package which covers the thermoformed container portion and which is heat-sealed about its periphery to form the fluid-tight package.

It will be understood that the thermoformed container assumes the configuration defined by the die that is horizontally positioned on the HTFFS machine and it will also be understood by those of ordinary skill in the art from the present description that in one embodiment, the package of the invention in use is rotated 90° after the cover or lidding sheet is heat-sealed so that the panel that serves as the supporting flat base of the package in use is oriented vertically in the die of the HTFFS machine. In this upright position for use or display, the relatively narrow top wall, or top seam will be over the supporting base and, if present, the dispensing tube or straw will extend vertically.

It will also be understood by those of ordinary skill in the art that flexible dispensing packages used for products sold at retail establishments can be formed from polymeric web materials of the same or different thickness and that the choice can be based on economic considerations. That is, use of one sheet or web that is of a thinner gauge than the thermoformed sheet will incur less cost per square unit of measure. Flexible packages used for lubricants, medicinal substances or in industrial applications can also require heavier gauge materials, which also can be of the same or different thicknesses.

The packages of the present invention can also be made from aluminum foils of various thicknesses that have been coated with, or laminated to a heat sealable polymeric material to provide a web or sheet that will retain a fold line, or a dead fold, or to serve other aesthetic and/or functional purposes. The gauge of these materials can be selected so that a package of a specified size will retain its stand-up shape configuration even when empty, should that be determined to be a desired feature for a particular application.

BRIEF DESCRIPTION OF THE DRAWINGS

The invention will be described in further detail below and with reference to the attached drawings in which the same numerals are used to refer to the same or similar elements, and where.

DETAILED DESCRIPTION OF PREFERRED EMBODIMENTS

Figure 1:
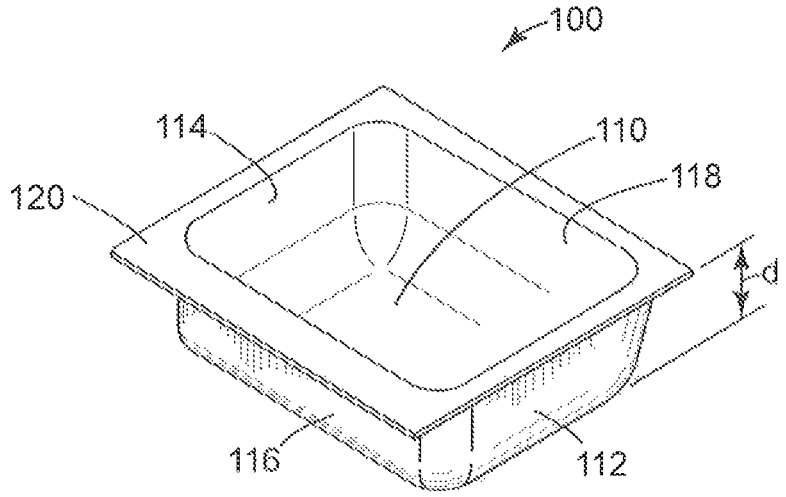
FIG. 1 Prior Art
FIG. 1 is a simplified schematic perspective view of a conventional horizontal thermoforming die of the prior art configured for producing a corresponding container having a rectilinear configuration where the opposing side walls extend upwardly the same distance "d" from the bottom or floor of the die.
Figure 2:
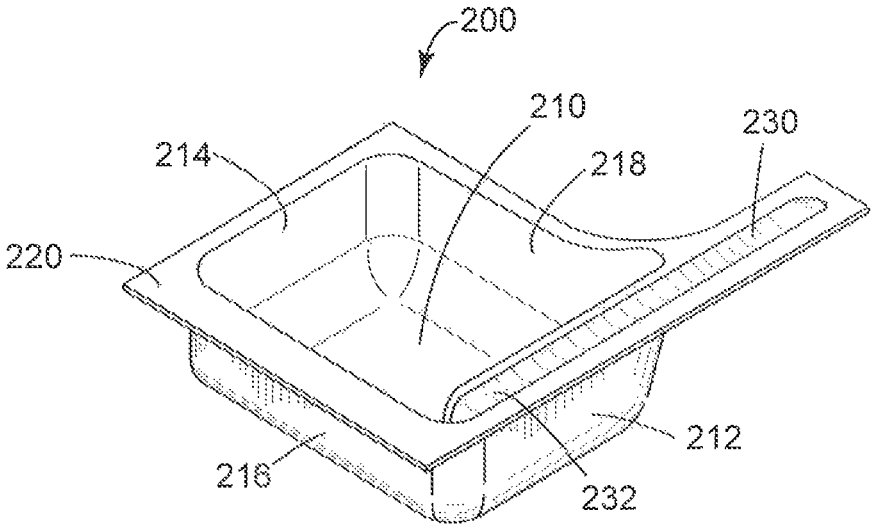
FIG. 2 Prior Art
FIG. 2 is a simplified schematic perspective view representative of a horizontal thermoforming die of the prior art for producing a corresponding rectilinear container that includes a dispensing tube with an internal extension terminating proximate the base of the container.

Referring to FIGS. 1 and 2, simplified representations of two dies of the prior art for producing corresponding thermoformed flexible containers of regular generally rectilinear configurations are shown. In FIG. 1, the die 100 includes container portion 110 having opposing side walls 112, 114, and front and rear walls 116, 118, respectively. The walls are of a uniformed height "d", and are bounded by a peripheral area 120.

In FIG. 2, the prior art die 200 includes similar elements numbered correspondingly, but the die includes a dispensing tube 230 having an internal extension 232 to provide the user with access to liquid contents at the base of the container when the tube is oriented in a vertical position.

Figure 3:
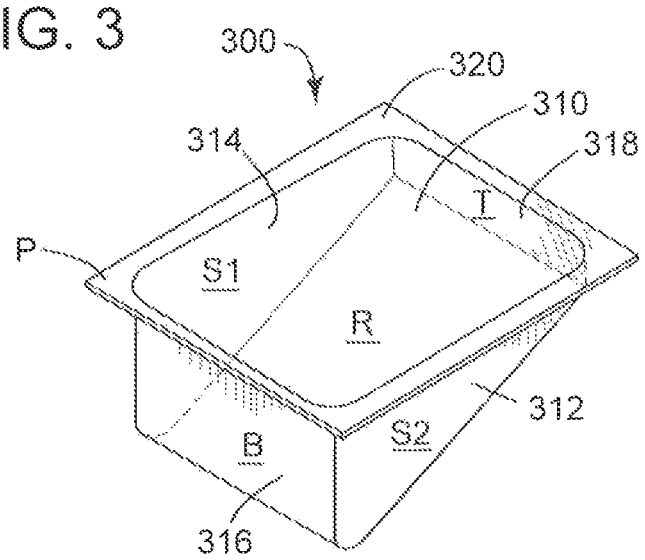
FIG. 3 is a simplified schematic perspective view of a horizontal thermoforming die configured and dimensioned in accordance with the present invention to produce an improved dispensing package having an enlarged base area that will support the filled package in an upright or stand-up orientation.
Figure 5:
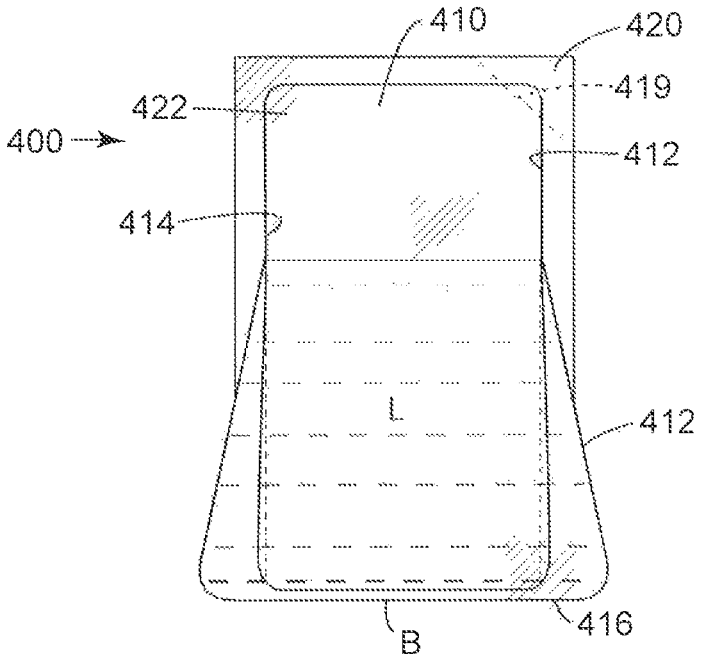
FIG. 5 is a rear elevation view of the filled flexible dispensing package of FIG. 4 containing, e.g., a liquid beverage "L", illustrating the expansion of the side walls by the liquid having the effect of lowering the center of gravity of the package.
Figure 6:
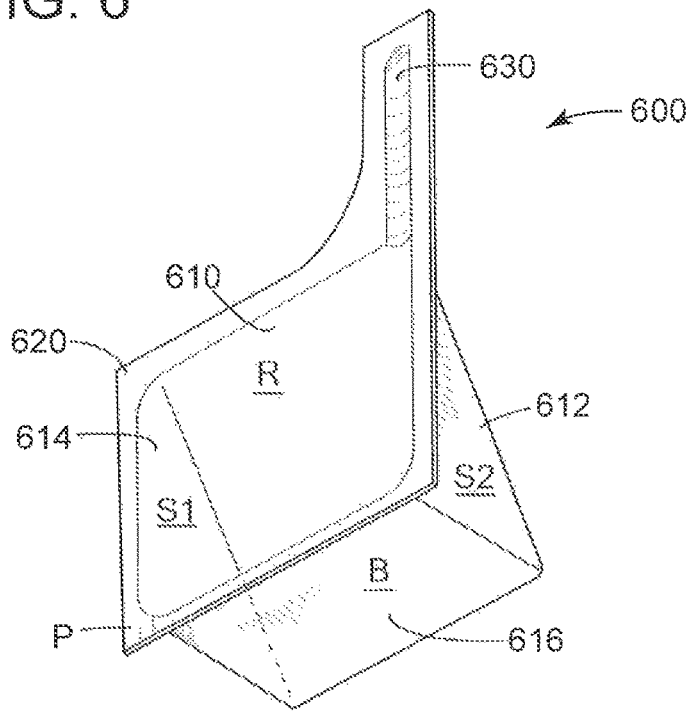
FIG. 6 is a bottom right side and front perspective view of a die that is similar to the die of FIG. 3 that is rotated 90° for purposes of illustration, and that is configured and dimensioned to produce a package with a supporting base and that also includes a dispensing tube.
Figure 7:
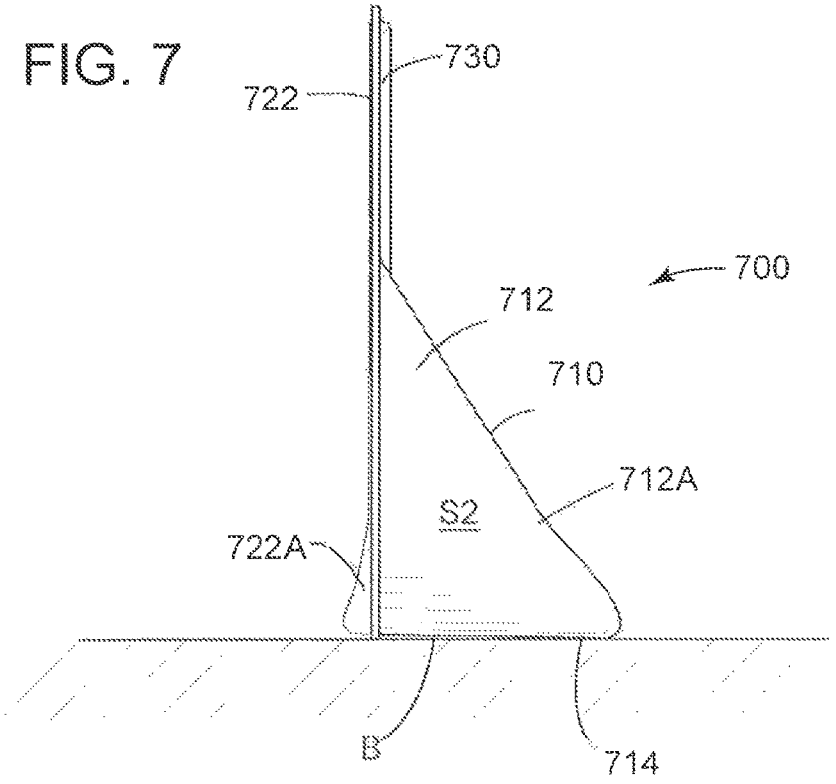
FIG. 7 is a side elevation view of a filled and sealed package produced in the die of FIG. 6 containing, e.g., a beverage, illustrating the expansion of the front and rears walls by the liquid and having the effect of lowering the center of gravity of the package.
Figure 8:
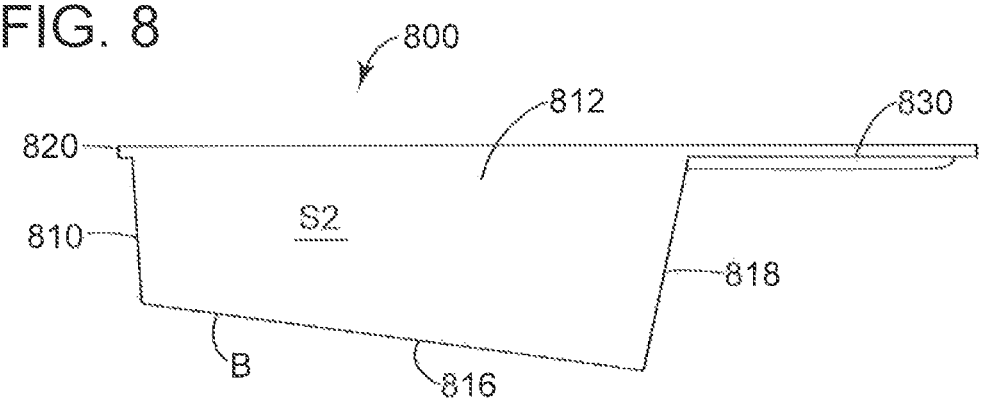
FIG. 8 is a simplified cross-sectional side view of a horizontal die for producing another embodiment of the self-supporting stand-up packaging of the invention in which the bottom of the die corresponds to the base of the filled package and the package includes a dispensing tube.
Figure 9:
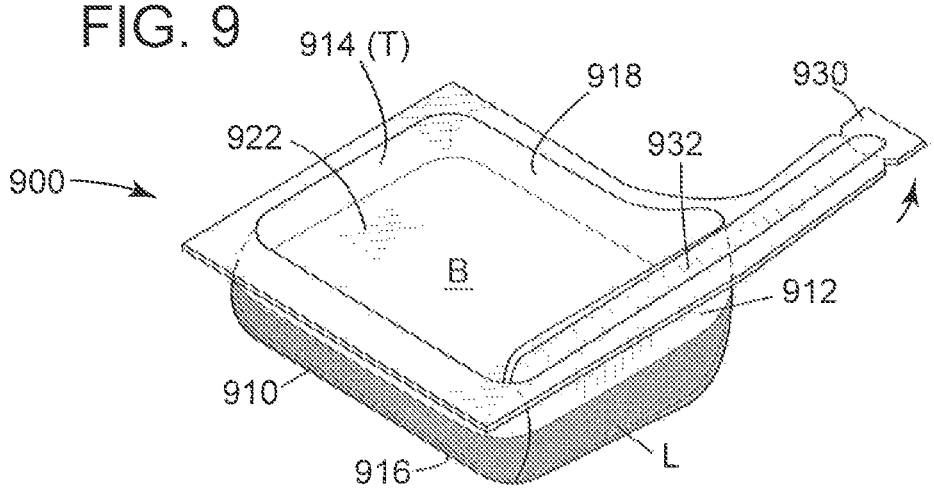
FIG. 9 is a simplified schematic perspective view of a finished, liquid-filled package produced in the die of FIG. 8 in which the fill line of the container portion of the package leaves an air space above the surface of the liquid.

FIGS. 3 through 9 illustrate, respectively, dies and the corresponding packages having supporting flat bases in accordance with the invention produced in the dies, including representative packages with dispensing tubes that serve as drinking straws in FIGS. 7 through 9. Referring to FIG. 3, the die 300 has opposing tapered side walls 312, 314, referred to S1 and S2; a supporting flat base 316, B1, top wall 318, T, and a bottom wall 310 of the die, labeled R. The opening defining the container portion of the eventual package is surrounded by the peripheral area 320 (P).

Figure 4:
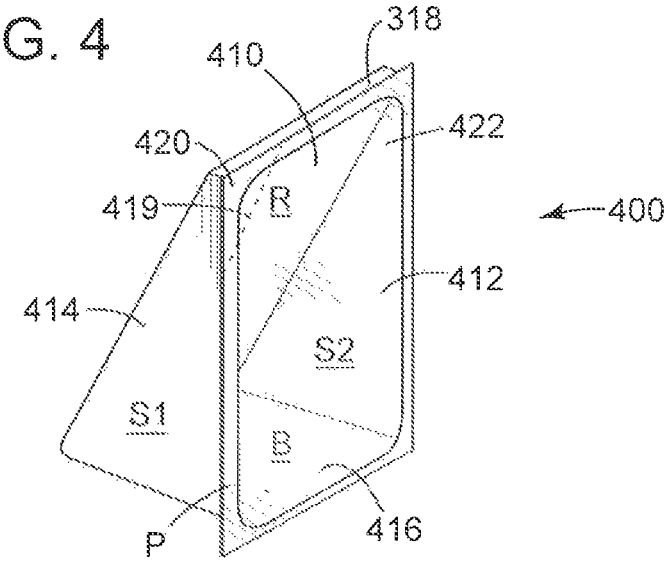
FIG. 4 is a perspective view of a finished package formed in the die of FIG. 3 with a heat-sealed cover or lidding as removed from the die and rotated 90° with the base in the horizontal plane in an unexpanded state.

Referring now to FIG. 4, the corresponding package 400 produced in the die of FIG. 3 after having been filled and top or cover lidding 422 heat-sealed to the periphery 420 (P) is shown rotated 90° from the molding position for use. Each of the corresponding elements S1, S2, B and R are shown in their respective positions corresponding to those panels of the die 300. These include opposing side walls 412 and 414, and bottom wall 410. Since the package 400 does not include a dispensing tube, a laser score line 419 is provided, for example, across the upper left-hand corner for removal by the user in order to dispense the contents of the package, e.g., by inverting it. It will be understood that if the package contents are a liquid, it will readily flow through the opening following removal of the corner section along score line 419. If the product is a condiment such as mustard, mayonnaise or ketsup, the user will squeeze the desired amount from the package. This configuration is also suitable for industrial products, such as heavy oils and greases which may be viscous, but can be made to flow under the application of the manual pressure applied by the user.

FIG. 5 is a further illustration of the package 400 that is shown with a liquid L which has caused the flexible side walls above the supporting flat base 416 (B) to expand outwardly and thereby lower the center of gravity of the package. It will be understood that this not only stabilizes the package so that it is self-supporting in the vertical or stand-up configuration, but also provides a space above the surface of the liquid that is below the tear line 419. Thus, when the upper right-hand corner is remove along tear line 419, the contents will remain in the package.

Referring now to FIG. 6, a die 600 is illustrated having a configuration that is similar to that of FIG. 3, with the understanding that for convenience of illustration, the die has been rotated 90° degrees from its horizontal position on the filling machine. In addition, the dispersing tube 630, is shown. The numbering of the elements in the 600 series, corresponds to those in the 300 series of FIG. 3.

In the side view of FIG. 7, the filled package 700 is shown containing, e.g., a flowable solid material that settles to the lower region causing an expansion 722A of the cover sheet 722, as well as an expansion of the rear wall 710 and side wall 712 at the lower portion 712A when the package 700 is placed on its supporting flat base 714 (B). The dispensing tube 730 projects from the top of the package 700 and is sealed by the cover lidding 722.

Referring now to FIG. 8, a die 800 for producing an embodiment of the invention in the form of a "flat package" includes a dispensing tube 830 extending above and intersecting front wall 818 which meets the base of the die 816 (B) also at an oblique angle. The side walls 812 (S2) are generally trapezoidal, with the rear wall 810 meeting the base 816 (B) at an oblique angle. The peripheral area 820 extends around the die in the same manner as described above with reference to the prior die configurations.

FIG. 9 shows the flat package 900 produced in the die that has been filled with a liquid (L), thereby causing the side walls 912, 914, rear wall 910 and top wall 918 to expand and the distal end of the dispensing tube 930 to rise at an angle acute to the horizontal supporting surface on which the package has been placed. The top or cover sheet 922 (T) retains the liquid and also maintains the integrity to the expanded package. Note that the distal or free end of the dispensing tube 930 includes a weakened tear line extending between notches to facilitate the manual removal of the sealed end for use of the dispensing tube and the dispensing tube terminates in internal extension 932.

As will be apparent to those of ordinary skill in the art, the improved packages of the invention are dimensioned and configured to contain a predetermined volume of liquid content, or weight of flowable solid material. Typical beverage containers for the United States market will accommodate 3, 5, 8, 12 or 16 ounces.

A package in accordance with FIG. 4 of the present invention produced in the die of FIG. 3 and having, for example, an eight-ounce liquid capacity can be configured with a base "B" measuring about 4"×5" with a maximum side wall dimension of about 2 inches. As will be understood by those of ordinary skill in the art, this is the "draw", or depth of the die. The package of FIG. 4 is provided with a laser score line 419 to facilitate removal of a corner section for dispensing of the contents. For the package of FIG. 7 that includes a straw produced in the die of FIG. 6, an additional width of about one-half inch can be provided. The dies can advantageously be configured to produce two packages with one draw, after which the packages are separated, e.g., by die-cutting.

A package suitable for a 12-ounce liquid fill has a base "B" measuring about 4.5" by 6", with a sidewall of about 2.5", the latter being the maximum depth and draw of the die. If the package is to be provided with the straw of FIG. 7, the base "B" of the die of FIG. 6 can be made about one inch wider. Variations and adaptations will be apparent from the above descriptions to the skilled worker in order to produce other package configurations.

As illustrated, the embodiments of the die and packaging of FIGS. 8 and 9, respectively, are provided with a dispensing tube 830, 930 that includes a contiguous internal extension 932 to facilitate withdrawal of liquid contents from the portion of the package opposite the dispensing tube. It will be understood that the internal extension can be omitted from applications in which the package is filled with a flowable material, e.g., ketsup, mustard, salad dressing, industrial oils and greases and other relatively viscous materials and the package will be inverted and manually squeezed to promote rapid dispensing. Such uses are described in U.S. published application 2015/0090740.

Figure 10:
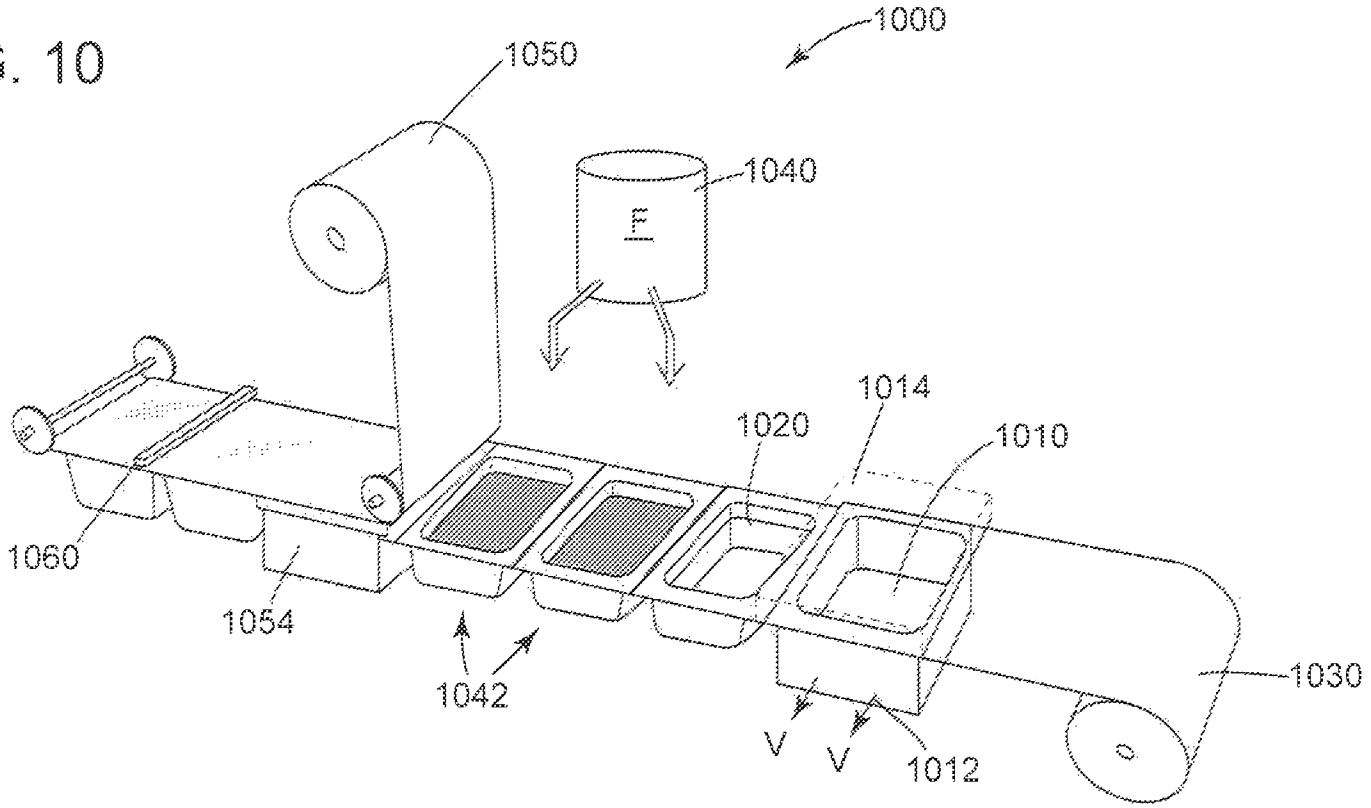
FIG. 10 is a highly simplified schematic view of apparatus of the prior art suitable for the stepwise production of the package, where the thermoformable film for producing the container portion is drawn from, e.g., a roll and across the open top of the horizontal die and then with the application of heat, vacuum "V", and optionally a male plug assist, the film conforms to the interior surface of the die so as to form the container portion of the package.

Referring now to FIG. 10, the method of producing the package with integrally formed supporting base for use in a bottom for stand up configuration will be briefly described with reference to the apparatus 1000. It will be understood that the steps illustrated are performed on a web or a sheet of plastic material that has properties that make it suitable for thermoforming. The material can be extruded or cast and can be composed of a monopolymer, e.g., polyethylene; a copolymer, e.g., a blend of resins such as polyethylene and ethylene vinyl acetate; a co-extrusion, i.e., a material composed of various resins, such as polyethylene, polypropylene, or nylon, which are extruded or cast as layers of a single web; or a laminate, i.e., a material composed of various resins such as polyethylene, polypropylene, or nylon, that are combined by adhering one sheet to one another via adhesive lamination or extrusion lamination. These are materials that can be heat-sealed as required to define a fluid-tight seal and are materials that can be readily die-cut. As will be understood by those familiar with the packaging art, the packaging material is advantageously printed while in the form of a web that is unwound for the purposes of printing and then rewound for use as a preprinted web in the eventual manufacturing steps that are to be described. As used in this description and in the claims which follow, it is to be understood that the term "sheet" is intended to include a web, as well as a sheet cut from a web during the step-wise manufacture of the product.

The package blank is defined as an area of a preprinted roll or web consisting of a top or cover section and a corresponding bottom section of the web defining the vacuum thermoformed container, that are continuously advanced to a position above the thermoforming station of the automated machine. For convenience and in the interest of clarity, the mold 1010 a shown, e.g., in FIG. 3 is shown in solid lines positioned below the bottom sheet 1030. It will also be understood that the bottom sheet assumes the corresponding configuration during the subsequent steps. The bottom section passes below a heating station 1014, is heated and thereby softened to facilitate the thermoforming step, which includes the application of a vacuum 1012 and, optionally, the use of a male plug assist (not shown) to fully form the container portion 1020, and one side of the dispensing tube portion of FIG. 7, if present. This step includes the forming of dissimilar side walls as shown in FIGS. 3, 4 and 6 through 9.

Figure 11:
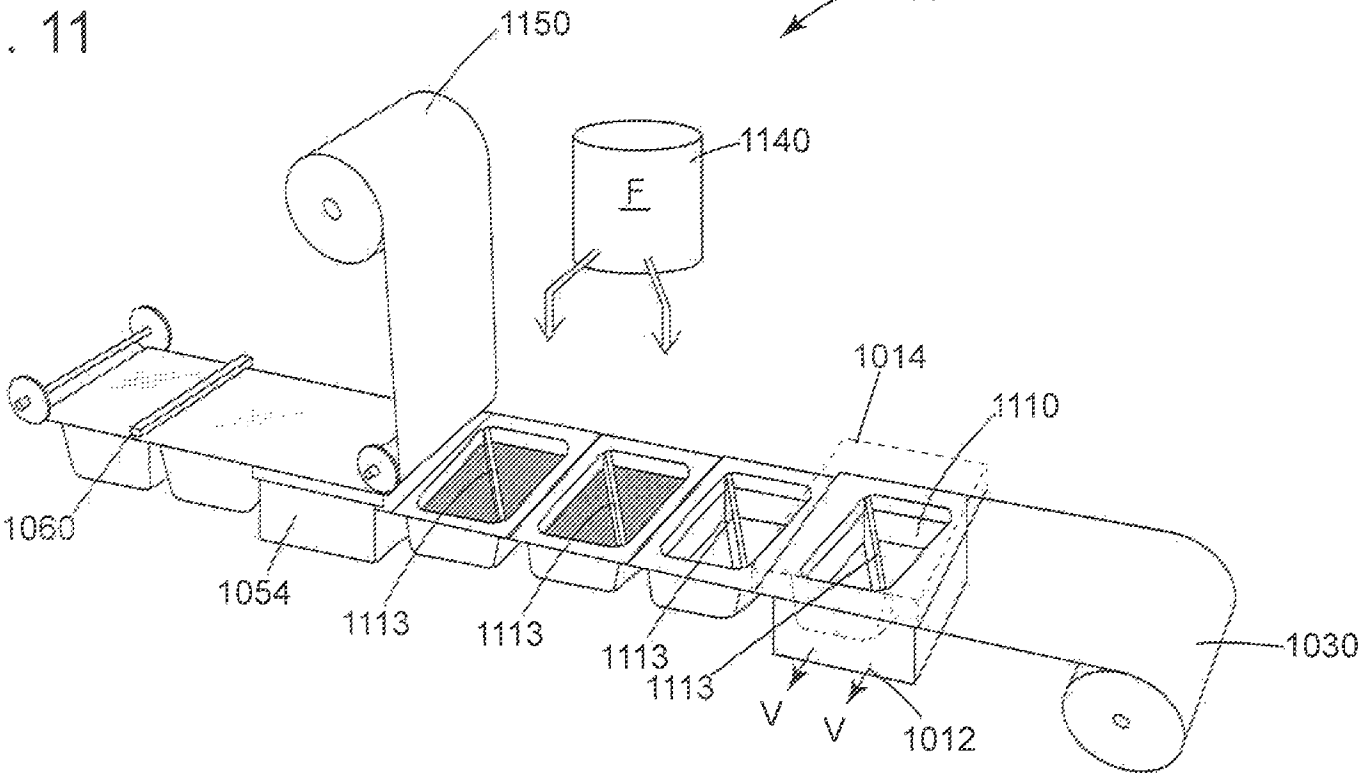
FIG. 11 is a schematic view similar to that illustrated in FIG. 10, where the die includes an internal diagonal wall extending vertically from the bottom of the die to form two relatively smaller packages.

Another embodiment of the invention is illustrated in FIG. 11 which can employ the similar apparatus 1100 and the stepwise method as described in connection with FIG. 10, but where the die 1110 includes a diagonal wall extending vertically from the bottom of the die to a height that is contacted by, and heat-sealed to the top or lidding sheet after the die has been filled from dispensing vessel 1140. It will be understood that each die produces two packages that can be sold as a unit, or subsequently divided along the narrow section formed at the top when the dual package is removed from the die 1110 after heat-sealing of the periphery, each section corresponding to its bifurcated section of the external straw extension.

In an alternative embodiment, the thermoformed container portion is advantageously filled 1042 from a container 1040 before the top sheet or web 1050 is positioned and sealed 1054 as described in the '941 patent. Some efficiency in production is achieved by avoiding the additional filling and sealing steps after the package is fully formed. The packages are separated 1060 and boxed for shipment.

In a configuration where the formed bottom provides a significant liquid capacity, the package can be filled through an opening in the top which is then heat-sealed to complete the package.

Referring now generally to the embodiments of FIGS. 3 and 6, the series of assembly steps schematically illustrated in FIG. 10, two separate webs or sheets, preferably of different thicknesses, are employed to produce the package of the invention. The container portion of the package is formed from a first or bottom sheet of a first thickness that includes a peripheral flange or margin around the die opening. In a subsequent step, a second or top cover sheet, that is preferably of a second thickness, is positioned in opposing relation to the bottom sheet and is heat-sealed to the flange of the bottom sheet. As will be understood by one of ordinary skill in the art, in order to achieve maximum productivity and efficiency based on the specific machine used in the process, the thermoformed container portion is filled, so that in the final stage of production the package is complete. This filling step generally occurs after the container has been formed in the die's cavity, but before the top cover sheet is sealed to the periphery of the bottom sheet.

Referring to FIG. 3, the thermoformed rectangular panel B is the base of the finished package. Referring to FIG. 4, in the next step, a rolled web supported on mandrel is positioned adjacent the assembly station in order to position a second or top sheet in contact with the exposed surface and superposed above thermoformed bottom web. The sheet is severed in the final die-cutting operation from web along a transverse line which corresponds to the opposing edge of thermo-formed web. As will be apparent to one of ordinary skill in the art, the forming of side B in the material withdrawn from the mill roll can be varied as to the relative time and location along the continuous production line, and it may be advantageous to do so closer to the roll.

In the operation illustrated, top or cover sheet is heat-sealed around its margins and along its opposing side peripheries to the respective edges of the thermoformed bottom web. The package is also heat-sealed as was explained in conjunction with the assembly of FIG. 4.

If the finished package is rectangular in shape it can also be separated by cutting techniques other than die-cutting, such as rotary blades and guillotine knives. Irregular shapes require die-cutting; regular shapes can be cut by the simpler and less expensive methods of straight cutting devices, including laser cutting.

Testing of the thermoformed flexible packages made in accordance with the invention shows that the completed, but unfilled package is generally not capable of self-support in the stand-up orientation. The use of lightweight packaging material for reasons of economy and the environment may result in its collapsing upon itself since it lacks the integrity to maintain the stand-up orientation when subjected to minor disturbances. However, when the thermoformed flexible package produced in accordance with the present invention is filled with a liquid, the liquid causes the lower portion of the package above the base to expand laterally when placed on a horizontal surface, thereby lowering the center of gravity and providing a stable container structure. As the liquid or other flowable solid contents of the container are withdrawn and the package with the remainder is placed on the horizontal surface, the remaining flowable contents continue to expand the lowermost portion supported by the base. When all of the contents have been removed and the package is returned to a horizontal surface, the upper portion of the package is naturally flexible and loses its shape and may no longer maintain the stand-up orientation. The package in accordance with the invention may not stand up unless it is at least partially filled with a liquid or other flowable material. In other words, product fill is required to form the shape of the package, unlike the prior art gusseted packages produced from flexible heat-sealable polymeric films.

Although a stand-up flexible package with an enlarged rectangular supporting base has been illustrated and described, as will be apparent to one of ordinary skill in the art, other shapes can be thermoformed, including circular, oval and combinations of curvilinear and rectilinear to provide novel flexible packaging shapes imitating nature's shapes for packages containing apple juice, lemonade and other fruit-flavored beverages. These shapes, particularly when combined with appropriately colored printed designs and labels that are pre-printed and indexed on the polymer webs serve as strong cues to consumers and lead to brand recognition. For example, the die can be formed with a wall for forming the package base housing a periphery that is curved, e.g., defining a portion of a circle and defining a flat surface. The adjoining regions of the side and rear walls would necessarily have the same contour as the base and the top wall can be rounded or rectangular. Due to the limitations of the HTFFS machine, the lidding or cover sheet will be flat.

As will be understood by those of ordinary skill in the packaging art, there are various types of filling methods and apparatus that can readily be adapted for use in filling the packages of the invention. The choice will be based upon the type of liquid and/or the viscosity of flowable material that is to be placed in the container portion of the package. When an HTFFS apparatus is used, it is efficient to fill the thermoformed container portion in the horizontal position as the formed unit moves from one station to the next. A readily flowable, low viscosity liquid such as beverage can advantageously be dispensed from the beverage reservoir by gravity flow with the fill tube positioned in close proximity to the open container portion. Obviously, flow rates must be controlled to prevent splashing of the material onto the margins of the thermoformed portion that are to be heat-sealed in a subsequent step.

Other types of filling apparatus include piston, auger, centrifugal and volumetric filling devices. For more viscous materials such as heavy oils and greases, air or hydraulic pressure can be applied to meet the filling-time requirements of the automated apparatus.

Multiple filling nozzles can also be employed for rapid introduction of the contents into containers having a relatively large volume. Substances subject to splashing can be introduced into the container portion using a bottom-up filling method where the tilling nozzle is raised and maintained at a position just above the surface of the rising material as the material fills the container portion of the bottom thermoformed sheet.

As will be understood by one of ordinary skill in the art, the thermoforming dies are heated and in communication with a vacuum pump that serves to draw the pre-heated bottom web into position to assume the internal contours of the die. The thermoforming step can optionally facilitated by the use of a plug-assist member (not shown) which contacts the web from above to assure that the bottom sheet assumes the desired contour as defined by the die.

Suitable materials that can be used as the thermoforming web and/or the lidding web that have the ability to be permanently formed, include the following:

formable aluminum foil, with or without a polymeric coating or laminated;

PCTFE, a fluoro polyester sold by DuPont under the trademark ACLAR;

cyclic olefin copolymers;

polystyrene;

co-polyesters;

GPET, an amorphous polyester; and

UPDA, an unplasticized PDC.

As described above, webs of plastic material that have properties that make it suitable for thermoforming can be extruded or cast and can be composed of a monopolymer, a copolymer, which are extruded or east as layers of a single web, or a laminate that are formed by adhering one sheet to one another via adhesive lamination or extrusion lamination.

Some of these materials are relatively more costly than conventional packaging polymers, and the aluminum foil has a relatively shallow depth of draw, but all have the desired property of maintaining a dead fold, which can result in a stand-up configuration for even the empty package should that feature be desired.

As was previously stated, the polymeric packaging material can be provided with appropriate graphics prior to its assembly into the finished package of the invention. At a printing facility, the web of material is unwound from its original roll, printed and then rewound onto a second roll for placement on the automated package forming equipment. One or a combination of printing processes such as lithography, flexography, process flexography, rotogravure, off-set and silk screening are well known in the packaging industry.

Also as previously noted, specialized packaging configurations that are representative of the source and/or nature of the liquid product in the container can be accentuated by the graphic design printed on the webs used to form the package. Choice of colors and representations of fruits such as apples, oranges and tomatoes applied to round or curvilinear packages containing their juices will achieve rapid consumer recognition.

In the interest of economy, the principal display panel of the package which is visible to the consumer on the shelf of a retail establishment can be printed as desired and the rear or remaining portion of the package left unprinted. This may be of particular interest for industrial products such as lubricating oils and the like, or for liquids that are packaged and placed in containers with cake mixes or other partially-prepared foods in which a number of ingredients are included in a box or package that is appropriately labeled.

While various exemplary embodiments of the invention have been described above and in the attached drawings, further modifications will be apparent to those of ordinary skill in the art from these examples and this description. The scope of the invention is to be determined with reference to the claims that follow.

The invention claimed is:

1. A flexible thermoformed dispensing package for a flowable material configured to assume a stand-up configuration when filled with the flowable material, the package produced from one or more flexible heat-sealable polymeric sheets and comprising:

a. a flexible thermoformed container portion formed in a shape-defining die from a flexible bottom sheet that includes a recessed chamber defined by a peripheral area, opposing trapezoidal or triangular side walls extending from a supporting flat base and terminating in a top wall or seam, and a rear wall extending from the base to the top wall or seam between the opposing tapered side walls; and b. a flexible top cover sheet superposed on, and heat-sealed to the peripheral area of the bottom sheet to form a fluid-tight seal, and thereby define the front wall of the flexible package, wherein the flexible side walls, front wall and rear wall of the sealed filled package above the flat base are deformed by the force of the flowable material and expand outwardly to lower the center of gravity of the flexible package when the flat base is placed on a horizontal surface in the stand-up configuration.

2. The flexible dispensing package of claim 1 in which the opposing side walls are trapezoidal and the top wall is parallel to, and defines an area substantially smaller than the area of the flat base.

3. The flexible dispensing package of claim 1 in which the opposing tapered side walls are triangular and the top cover sheet and the rear wall are heat-sealed at the periphery of the recessed chamber to define a seam.

4. The flexible dispensing package of claim 1 in which the flat base is normal to the top cover sheet.

5. The flexible dispensing package of claim 1 in which the flat base is normal to the opposing side walls.

6. The flexible dispensing package of claim 1 which includes a weakened separation line extending across a corner of the container portion of the package and intersecting the top cover sheet, rear wall, one side wall and adjacent peripheral area to facilitate manual removal of a portion of the package external to the separation line for dispensing of the contents of the package.

7. The flexible dispensing package of claim 1 in which the flexible bottom sheet is comprised of at least two layers of flexible polymeric material.

8. The flexible dispensing package of claim 1 in which the exterior surface of the top cover sheet defining the front wall of the package or the rear wall, or both, includes printed indicia.

9. The flexible dispensing package of claim 1 which includes a dividing wall extending diagonally between opposing corners of the recessed chamber and between the rear wall and front wall, the upper surface of the dividing wall being heat-sealed to the top cover sheet to define two container portions.

10. The flexible dispensing package of claim 1 which includes a dispensing tube integrally formed with the container portion and bounded by a contiguous peripheral area, the dispensing tube defining a dispensing channel, the base of the dispensing tube being in uninterrupted fluid communication with the chamber, the package container portion and integral dispensing tube being thermoformed from the bottom sheet, wherein the top cover sheet is also superposed on, and heat-sealed to the periphery of the dispensing tube to form the fluid-tight dispensing package.

11. The dispensing package of claim 10, further comprising:

an internal extension of the dispensing tube that extends into the chamber of the container portion and that is formed in a portion of the bottom sheet, the internal extension being defined by at least one heat-sealable elongated region extending from the peripheral area adjacent the base of the dispensing tube, the internal extension terminating in an open end positioned proximate the base wall of the container portion to facilitate withdrawal of the flowable material when the dispensing tube is in a generally vertical orientation, wherein the top cover sheet is also superposed on, and heat-sealed to the periphery of the elongated region to form the fluid-tight dispensing package.

12. The package of claim 10 in which the internal extension of the dispensing tube is contiguous to a side wall of the recessed chamber of the container portion.

13. The package of claim 10 in which the dispensing tube and its internal extension are spaced-apart from and intermediate the side walls of the recessed chamber.

14. The package of claim 11 in which the heat-sealable elongated region includes the upper surface of the an interior partition wall extending to the bottom surface of the recessed chamber.

* * * * *